United States Patent [19]

Maggs

[11] Patent Number: 4,888,844

[45] Date of Patent: Dec. 26, 1989

[54] TOOTHBRUSH FOR NATURAL TEETH AND DENTURES

[76] Inventor: Norman B. Maggs, 222 Fonda Rd., Waterford, N.Y. 12188

[21] Appl. No.: 238,483

[22] Filed: Aug. 31, 1988

[51] Int. Cl.[4] ..... A46B 9/04

[52] U.S. Cl. ..... 15/106; 15/167.1; D4/104

[58] Field of Search ..... 15/167.1, 167.2, 106, 15/160, 110, DIG. 5, 6; 128/62 A; D4/104–113, 128, 133

[56] References Cited

U.S. PATENT DOCUMENTS

| | | | |
|---|---|---|---|
| 160,552 | 3/1875 | Stevens | 15/225 |
| 1,813,076 | 7/1931 | Newell | 15/106 |

FOREIGN PATENT DOCUMENTS

| | | | |
|---|---|---|---|
| 3435713 | 4/1986 | Fed. Rep. of Germany . | |
| 17666 | of 1895 | United Kingdom | 15/167.1 |
| 265690 | 2/1927 | United Kingdom | 15/167.1 |

*Primary Examiner*—Peter Feldman

*Attorney, Agent, or Firm*—John W. Huckert

[57] ABSTRACT

A multi-purpose toothbrush for cleaning and brushing a person's natural teeth and also his or her dentures. The device comprises an elongated handle for holding same by a user. An enlarged bulbous member is provided at one end of the handle. This member has a large number of bristles extending outwardly therefrom. One area of bristles has a substantially flat surface while the rest of the bristles provide a curved surface. Two parallel side edges are provided by the junctions between the flat surface and the curved surface. The very end of the bristle covered member is rounded. The side edges and rounded end are very useful in cleaning dentures.

9 Claims, 1 Drawing Sheet

TOOTHBRUSH FOR NATURAL TEETH AND DENTURES

BACKGROUND OF THE INVENTION

1. Field of the Invention

This invention relates generally to devices for brushing and cleaning natural teeth as well as dentures.

2. Description of the Prior Art

A common problem with known devices for brushing teeth is that they do not clean dentures very well. And apparatus available for cleaning dentures generally is not suitable for use on natural teeth, and often such apparatus is very complicated and expensive.

Another common problem of known type toothbrushes is that they do not have the necessary surfaces and edges to properly clean and brush dentures in addition to natural teeth.

A further problem is that known type brushes for denture plates have large handles which will not fit in conventional toothbrush holders.

Existing prior Design patents which may relate to this invention are as follows:

Des. 246,080; Des. 276,193; Des. 279,838; Des. 281,202; Des. 282,317; Des. 281,375, and Des. 248,696.

However, none of these patents show the device of the present invention, nor do any of the known prior art devices offer the new and novel features of the present invention.

SUMMARY OF THE INVENTION

An object of the present invention is to provide a toothbrush having a plurality of brushing surfaces and edges for use by a person to clean both natural teeth and dentures.

An additional object of the present invention is to provide a toothbrush having structure for the good cleaning of natural teeth as well as surfaces and edges for the efficient cleaning of dentures.

Another object of this invention is to provide a toothbrush having a handle for holding same by a user which is of a size to fit in a conventional toothbrush holder and which handle has an enlarged member at one end thereof with bristles thereon for cleaning and brushing real teeth as well as false teeth.

A further object of this invention is to provide a multi-purpose toothbrush having a plurality of brushing surfaces, elongated edges, and a rounded end.

A still further object of this invention is a brushing device having an elongated flat bristle surface, an elongated curved bristle surface, and a rounded bristle end.

Yet another object of this invention is a brushing device having an elongated flat brushing surface joining with a complementary elongated curved brushing surface at parallel side edges which provide elongated angled edges.

The present invention offers many very important and desirable advantages and benefits over known dental brushes. Namely, a multi-purpose toothbrush for cleaning and brushing a person's natural teeth and also his or her dentures. The device comprises an elongated handle for holding same by a user. An enlarged bulbous member is provided at one end of the handle. This member has a large number of bristles extending outwardly therefrom. One area of bristles has a substantially flat surface while the rest of the bristles provide a curved surface. Two parallel side edges are provided by the junctions between the flat surface and the curved surface. The very end of the bristle covered member is rounded. The side edges and rounded end are very useful in cleaning dentures. Also, the handle is of conventional toothbrush size so this device can be stored in the usual bathroom toothbrush holder.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
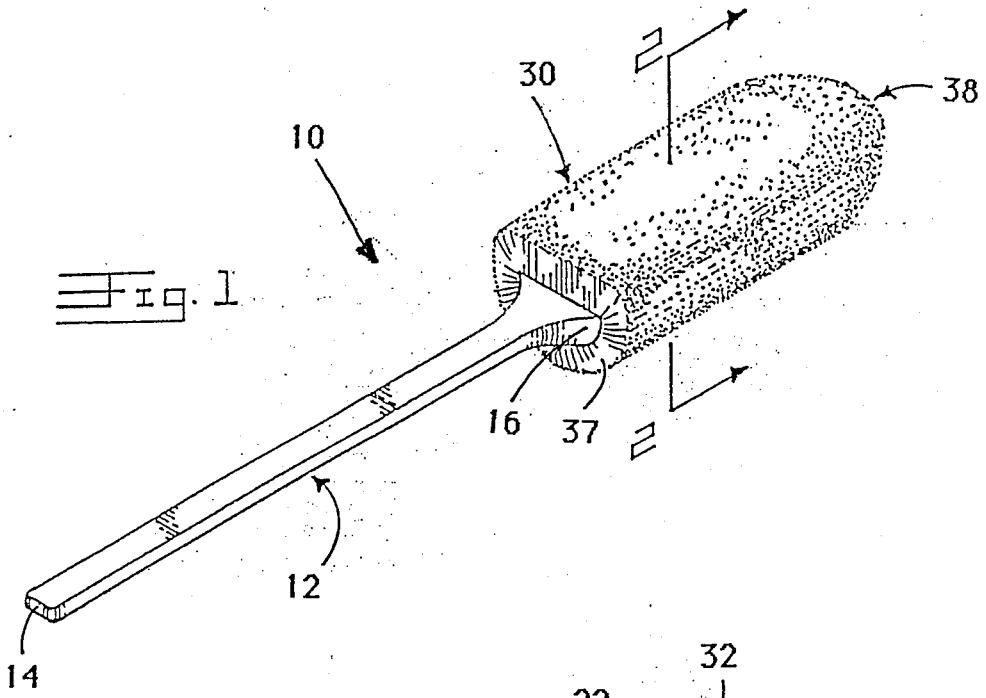
FIG. 1 is a perspective view of the multi-purpose toothbrush of the present invention for cleaning and brushing a user's natural and false teeth(dentures).

Looking at FIG. 1 of the drawing reference numeral 10 indicates the toothbrush of the present invention. An elongated handle 12 has a blunt end 14 and an enlarged bulbous member 18 at the other end. Tapered portions 16 smoothly join member 18 with handle 12. Both the thickness and width of member 18 are substantially greater than that of handle 12. This can best be seen in the cross-section of FIG. 2.

Preferably handle 12 is of conventional toothbrush handle size so that the device can fit into a conventional type toothbrush holder. This is important since many of the known tyoe brushes for dentures have handles too large to fit such holders which substantially reduce the convenience thereof.

The enlarged bulbous member 18 has a flat smooth surface 22 and a curved surface 24 both of which extend the entire length of member 18 to the free end which is rounded. Both handle 12 and member 18 may be of plastic material and of integral one-piece construction.

Figure 2:
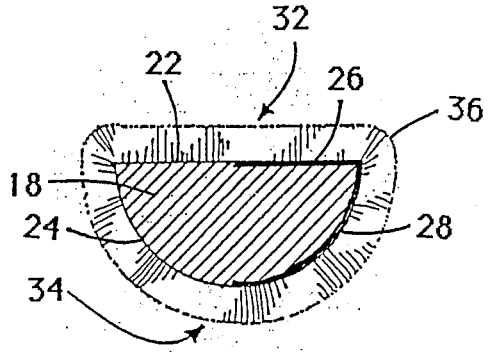
FIG. 2 is a detailed cross-section taken along line 2—2 of FIG. 1.

A plurality of bristles are affixed to the member 18. Securement of the bristles may be by imbeddment of bristle tuffs in the member 18, as in conventional type toothbrushes. Or the bristles may be affixed, as shown in FIG. 2, by layers of adhesive 26, 28.

In order to achieve the desired improved results of this device, the free ends of the bristles are in the same shape as the underlying and supporting member 18. For example the bristle head 30 has a flat surface 32, and a curved surface 34. Angled edges 36 occur where the surfaces 32 and 34 join providing a pair of parallel elongated bristle edges. The handle end of head 30 has a flat surface 32, and the other head end has a rounded surface 38.

In use the flat surface 32 can be used in normal manner to brush one's teeth. Also, in many instances, the curved surface 34 may be used. When the user desires to clean his or her dentures, then in addition too surfaces 32 and 34, the fairly sharp edges 36 and the rounded end 38 are available.

Thus, with just this one device, a user can very thoughly and efficiently clean both natural and false teeth. No additional devices or appliances are needed to do an excellent cleaning job. And when not in use the toothbrush of this invention can be stored in the usual home bathroom holder ready for convenient use again and again.

The foregoing is considered as illustrative only of the principles of the invention. Further, since numerous modifications and changes will readily occur to those skilled in the art, it is not desired to limit the invention to the exact construction shown and described, and accordingly, all suitable modifications and equivalents may be resorted to, falling within the scope of the invention.

What is claimed is:

1. A toothbrush for brushing dentures as well as natural teeth comprising:

an elongated body member having an enlarged portion at one end and a handle portion at the other end;

said handle portion being substantially longer than said enlarged portion;

bristles completely covering said enlarged bulbous member;

said enlarged portion having first bristle means thereon suitable for cleaning natural teeth;

shaped second bristle means on said enlarged portion for cleaning dentures;

said first bristle means providing a flat surface;

said shaped second bristle means providing a curved surface; and two parallel side edges being formed by the junctions between said flat surface and said curved surface.

2. A toothbrush as set forth in claim 1, together with additional means at the very end of said enlarged end for brushing grooves in dentures.

3. A toothbrush as set forth in claim 2, wherein said additional means at the very end of said enlarged portion comprises bristles extending longitudinally of the toothbrush and with the outer ends thereof providing a rounded surface.

4. A multi-purpose device for cleaning and brushing teeth and dentures comprising:

a handle for holding by a user of the device;

an enlarged bulbous member at one end of the handle;

bristles completely covering said enlarged bulbous member;

first means provided by said bristles for brushing the user's natural teeth;

second means provided by said bristles for brushing the user's false teeth;

said enlarged bulbous member being substantially wider and thicker than said handle;

a portion of said enlarged bulbous member providing a flat surface for supporting said first means;

another portion of said enlarged bulbous member providing a curved surface for supporting said second means; and elongated cleaning edges being formed along the areas where said first means and said second means join.

5. A multi-purpose device for cleaning and brushing teeth and dentures as set forth in claim 1, wherein the end of said enlarged bulbous member opposite the handle is rounded for supporting third means for cleaning grooves in dentures.

6. A toothbrush as set forth in claim 5, said third means comprises bristles extending longitudinally of the toothbrush and with the outer ends thereof providing a rounded surface.

7. A multi-purpose device for cleaning and brushing teeth and dentures as set forth in claim 5, wherein said handle is sized to fit conventional toothbrush holders.

8. A multi-purpose device for cleaning and brushing teeth and dentures as set forth in claim 7, wherein said handle has a blunt free end and tapered filets at the junction thereof with said enlarged bulbous member.

9. A multi-purpose device for cleaning and brushing teeth and dentures as set forth in claim 1, wherein said handle has a blunt free end and tapered filets at the junction thereof with said enlarged bulbous member.

* * * * *